US008960070B2

(12) United States Patent
Gu

(10) Patent No.: US 8,960,070 B2
(45) Date of Patent: Feb. 24, 2015

(54) SEWAGE SUCTION DEVICE

(76) Inventor: Guoqing Gu, Edison, NJ (US)

( * ) Notice: Subject to any disclaimer, the term of this patent is extended or adjusted under 35 U.S.C. 154(b) by 613 days.

(21) Appl. No.: 13/387,006

(22) PCT Filed: Apr. 7, 2010

(86) PCT No.: PCT/CN2010/071613
§ 371 (c)(1),
(2), (4) Date: Jan. 25, 2012

(87) PCT Pub. No.: WO2011/026327
PCT Pub. Date: Mar. 10, 2011

(65) Prior Publication Data

US 2012/0118142 A1 May 17, 2012

(30) Foreign Application Priority Data

Sep. 4, 2009 (CN) ..... 2009 1 01951982

(51) Int. Cl.
*F15B 15/26* (2006.01)
*F15B 15/14* (2006.01)
*E03D 5/00* (2006.01)
*E03F 1/00* (2006.01)

(52) U.S. Cl.
CPC .. *E03D 5/00* (2013.01); *E03F 1/006* (2013.01)
USPC ..... 92/23; 92/117 R

(58) Field of Classification Search
USPC ..... 92/23, 130 C, 171.1, 117 R, 21 MR, 92/117 A; 4/395–398, 405, 410, 421; 137/151, 147, 148
See application file for complete search history.

(56) References Cited

FOREIGN PATENT DOCUMENTS

CN 1563618 A * 1/2005 ..... E03D 11/10

* cited by examiner

*Primary Examiner* — Edward Look
*Assistant Examiner* — Daniel Collins
(74) *Attorney, Agent, or Firm* — Gearhart Law, LLC

(57) ABSTRACT

The invention discloses a suction drainage device that comprises: a cylinder sleeve where the inside of the cylinder sleeve is provided with a step hole and the wall of the cylinder sleeve has a waste-discharging outlet; a cylinder liner with a bottom that includes a shaft hole and where the wall of the cylinder liner is provided with a flange; a piston with a piston rod; a cylinder sleeve cover with a step hole along the axis, and the body is also provided with a hanging hole; a cylinder liner lock that clutches the piston rod; a shifting fork assembly that is fixed inside the step hole of the cylinder sleeve cover; a ring shaped cylindrical liner lock seat that includes a slope and a pivot pin; an annular end cover that contains a through hole in its center, wherein: the cylinder liner is located inside the cylinder sleeve, the piston is located inside the cylinder liner; the cylinder sleeve cover is connected to the cylinder sleeve along the axis; the cylinder liner lock seat is located in between the cylinder sleeve and cylinder sleeve cover; the annular end cover caps the cylinder sleeve cover. The invention utilizes the two-stage movement of the piston and the cylinder liner, which greatly reduces the piston stroke without reducing its efficiency. Its advantages include compact structure, convenient operation and high efficiency.

11 Claims, 2 Drawing Sheets

SEWAGE SUCTION DEVICE

This application is a national application of PCT-application PCT/CN 2010/071613 filed on Apr. 7, 2010, which claims priority of the Chinese application CN 2009101951982 filed on Sep. 4 2009, both of which are incorporated herein by reference.

FIELD OF INVENTION

This invention relates to the field of sanitary technology. In particular this invention relates to a device that strengthens the sewage pumping system implemented on a toilet.

TECHNOLOGY BACKGROUND

The application of the siphon principle on a toilet to strengthen sewage suction is widely used. Under atmospheric pressure, the release of water from the water tank generates the siphon phenomenon that increases the efficiency of drainage. However, this siphon phenomenon requires a large amount of water to ensure proper drainage. In order to reduce water consumption, Chinese Patent Application No. 200410022242.7 discloses a suction-type water-saving toilet. The structure includes a piston tube at the end of the toilet siphon tube. The piston movement within the piston tube creates negative pressure at the end of the siphon tube. This causes the water in the pipeline to siphon rapidly, thereby decreasing water consumption. Due to the size limitation of the toilet itself, the installation location and the operational space are limited. In addition, the piston head exerts a large working stroke. To allow the piston head to complete an entire working stroke, a complex structure which includes pulling string, scroll and rod is used. This design in turn results in defects such as complexity in structure, difficulty in operation, and low efficiency, etc., and hence restricting the technology and general application of such "suction-type water-saving toilet".

SUMMARY OF THE INVENTION

The purpose of the current invention is to replace the inadequacies that are present in the existing technology of the sewerage-pumping device. This invention utilizes the two-stage movement of a piston and a cylinder liner and greatly reduces the piston stroke without reducing its efficiency. Its advantages include compact structure, convenient operation and high efficiency.

In order to allow the invention to perform its function, the technical plan includes the following:

A sewage suction device that includes:

A cylindrical sleeve where the interior of the sleeve includes a stepped hole; the wall of the sleeve includes a waste-discharging outlet;

A cylinder liner with a bottom that includes a shaft hole; the cylinder wall is provided with a flange;

A piston with a piston rod;

A cylinder sleeve cover with a stepped hole along its axis; the body of the cylinder sleeve cover is also provided with a hanging hole;

A cylinder liner lock that clutches the piston rod;

A shifting fork assembly that resides inside the stepped hole of the cylinder sleeve cover;

A ring shaped cylinder liner lock seat is provided with a slope and a pivot pin;

An annular end cover provided with a through hole in its center;

In which: the cylinder liner with a bottom is located inside the cylinder sleeve; the piston is located in the cylinder liner; the cylinder sleeve cover is connected to the cylinder sleeve along the cylindrical axis, the cylinder liner lock seat is located in between the cylinder sleeve and cylinder sleeve cover, the annular end cover is caped on the cylinder sleeve cover.

A first spring is located between the cylinder liner and the cylinder sleeve.

The shifting fork assembly is made up of a shifting fork body, a lock bolt, a shifting fork rod and a shifting fork ring; an opening is located radial symmetrically on the cylindrical shaped shifting fork body, the lock bolt is positioned inside the opening and connected to the shifting fork body by pivot pins; the shifting fork ring encircles the outer shifting fork body; one side of the shifting fork rod connects to the shifting fork ring and the other side extends out of the cylinder sleeve cover; a second spring is located in between the shifting fork ring and the cylinder sleeve cover.

The piston rod is provided with a left flange, a right flange and a locking ring; a third spring is located between the locking ring and the shifting fork body.

The cylinder liner lock is composed of a lining, a top cap and a lock plate; a cam is positioned on the lock plate by a pivot pin, a top cap and a lock plate cover the lining, where the lining encases the piston rod.

The cylinder liner lock seat is connect to the lock pendulum by the pivot pin; the lock pendulum is provided with a lock swing; the forth spring is located in between the lock swing and the lock pendulum; the fifth spring is located in between the lock pendulum and the cylinder liner lock seat.

The lock bolt is provided with a circlip spring.

The invention utilizes the two-stage movement of the piston and the cylinder liner. The first stage comprises the working stroke, in which the piston is in motion and the cylinder liner is stationary. This leads to the formation of negative pressure inside the cylinder liner that is located at the end of the toilet siphon, which in turn forces water to start a rapid siphon in the pipeline and therefore completes the pumping. The second stage does not increase working stroke. At this stage the cylinder liner is active and the piston is stationary. The cylinder liner moves along the piston rod that is located inside the cylinder sleeve, and therefore opens the waste-discharging outlet on the cylinder sleeve. This allows the waste to be discharged through the sewer pipe. Consequently, the device greatly reduces the piston stroke without reducing its efficiency. The advantages of the current invention include compact structure, convenient operation and high efficiency.

DESCRIPTION OF THE PREFERRED EMBODIMENT

Figure 1:
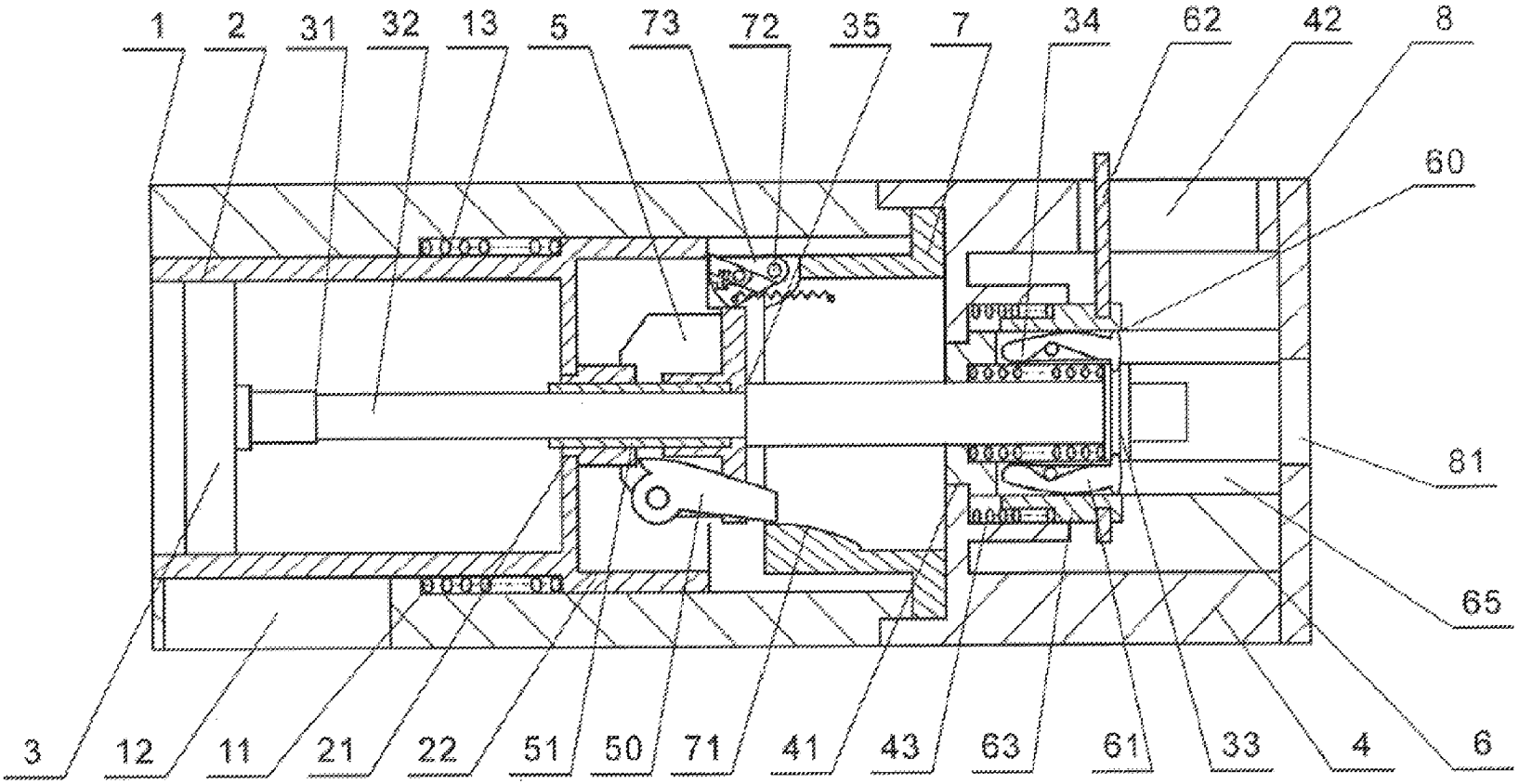
FIG. 1 is the general structural schematic drawing of the invention.

See FIG. 1, the invention includes:

A cylindrical sleeve (1) where an inside of the sleeve includes a stepped hole (11);

a wall of the sleeve includes a waste-discharging outlet (12);

A cylinder liner with a bottom (2) that includes a shaft hole (21); the cylinder wall of the cylinder liner is provided with a flange (22);

A piston (3) with a piston rod (32);

A cylinder sleeve cover (4) with a stepped hole (41) along its axis; the body of the cylinder sleeve cover is also provided with a hanging hole (42);

A cylinder liner lock (5) that clutches the piston rod (32);

A shifting fork assembly (6) that is fixed inside the stepped hole (41) of the cylinder cover (4);

A ring shaped cylinder liner lock seat (7) is provided with a slope (71) and a pivot pin (72);

An annular end cover (8) is provided with a through hole (81) in its center;

Wherein: the cylinder liner with a bottom (2) is located inside the cylinder sleeve (1), the piston (3) is located inside the cylinder liner (2); the cylinder sleeve cover (4) is connected to the cylinder sleeve (1) along an axis; the cylinder liner lock seat (7) is located in between the cylinder sleeve (1) and cylinder sleeve cover (4), the annular end cover (8) caps the cylinder sleeve cover (4).

A first spring (13) is located between the cylinder liner (2) and the cylinder sleeve (1).

The piston rod (32) is provided with a left flange (31), a right flange (35) and a locking ring (33); a third spring (34) is located between the locking ring (33) and a shifting fork body (60).

Figure 4:
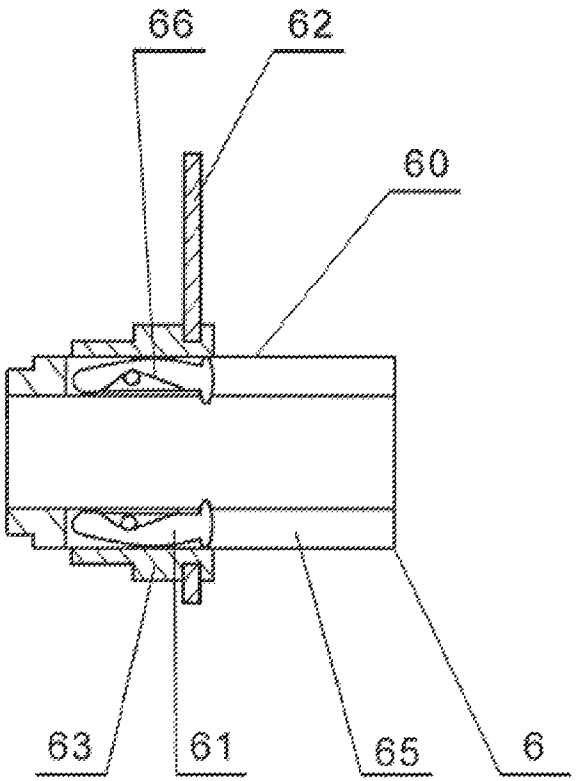
FIG. 4 is the structural schematic drawing of the shifting fork assembly of the invention.

See FIG. 4, the shifting fork assembly (6) comprises: a shifting fork body (60), a lock bolt (61), a shifting fork rod (62) and a shifting fork ring (63); wherein the shifting fork body (60) is cylindrical shaped, an opening (65) is located radial symmetrically on the shifting fork body; the lock bolt (61) is positioned inside that opening (65) and connected to the shifting fork body (60) by pivot pins; the lock bolt (61) is provided with a circlip spring (66); the shifting fork ring (63) encircles the shifting fork body's (60) outer diameter; one end of the shifting fork rod (62) connects the shifting fork ring (63) and the other end extends out of the cylinder cover (4); a second spring (43) is located between the shafting fork ring (63) and the cylinder cover (4).

Figure 2:
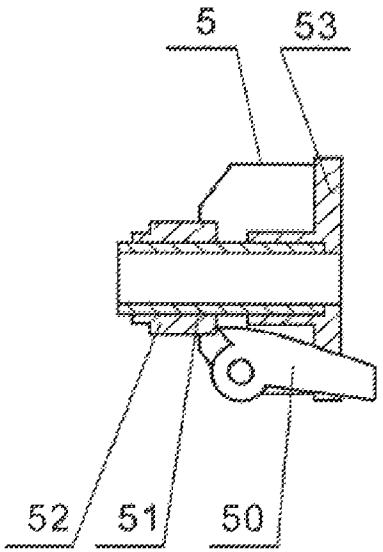
FIG. 2 is the structural schematic drawing of the cylinder liner lock of the invention.

In FIG. 2, the cylinder liner lock (5) comprises a lining (51), a top cap (52) and a lock plate (53); the cam (50) is positioned on the lock plate (53) by a pivot pin; the top cap (52) and the lock plate (53) is located outside the lining (51), the lining (51) encases the piston rod (32).

Figure 3:
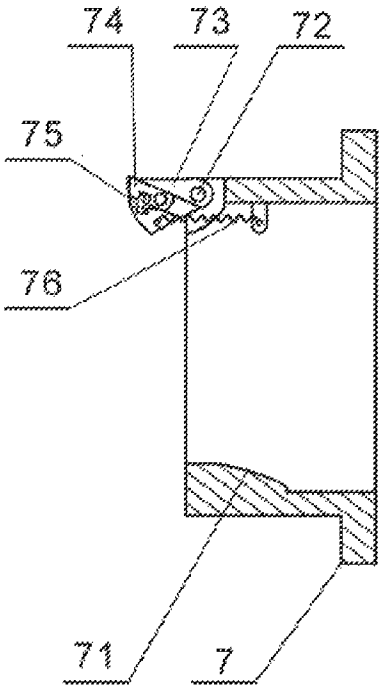
FIG. 3 is the structural schematic drawing of the cylinder liner lock seat of the invention.

In FIG. 3, the cylinder liner lock seat (7) is connected to the lock pendulum (73) by pivot pin (72); the lock pendulum (73) is provided with a lock swing (74); a forth spring (75) is located in between the lock swing (74) and the lock pendulum (73); a fifth spring (76) is located in between the lock pendulum (73) and the cylinder liner lock seat (7).

The invention works in the following way:

Connect the device to the end of a toilet siphon by attaching the side of the cylinder sleeve (1) that contains the piston (3) to the siphon; connect the waste-discharging outlet (12) to a sewer pipe; connect the shifting fork rod (62) that is located outside the hanging hole (42) and extends out of the cylinder sleeve (1) to the flush handle pulling string of the toilet water tank; connect the side of the piston rod (32) that contains the locking ring (33) with a connecting rod and through the through hole (81) of the annular end cover (8) to the pulling string of the floating chamber that is located inside the water tank.

Flushing Process:

Turn the flush handle, as the reset lever in a toilet opens the water tank flush valve, the shifting fork rod (62) shifts. Meanwhile, the shifting fork rod (62) together with the shifting fork ring (63) overcomes the resistance of the second spring (43) that's located on the outer diameter of the shifting fork body (60) and moves to the left. This causes the tip of the lock bolt (61) to expose out of the shifting fork ring (63). The lock bolt (61) then opens due to the force from the circlip spring (66). The lock bolt (61) is disconnected from the locking ring (33) that is located on the piston rod (32). The third spring (34) pushes the locking ring (33), the piston rod (32) and the piston (3) to the right inside the cylinder liner (2), producing a negative pressure at the end of the toilet siphon and inside the cylinder liner (2). This forces the water to rapidly siphon inside the pipe. As the piston (3) continues to move to the right, the left flange (31) of the piston rod (32) pushes the lining (51) and the lock plate (53) to the right. The lock plate (53) then disconnects from the lock pendulum (73). Under the force of the fifth spring (76), the lock pendulum (73) rotates around the pivot pin (72), releasing any constraint that was exerted on the cylinder liner (2) by the lock swing (74). The force of the first spring (13) causes the cylinder liner (2) to move to the right along the piston rod (32) inside the cylinder sleeve (1). This in turn opens up the waste-discharging outlet (12) on the cylinder sleeve (1), allowing wastes to be discharged through the sewer pipe. This completes the flushing process.

Reset Process:

When the water level in the tank drops below the set minimum position, the flush valve closes automatically and the flush handle self resets. As the floating chamber pulling string pulls the connecting rod, the action pushes the piston rod (32) and the piston (3) to the left inside the cylinder liner (2). As the piston (3) continues to move to the left, the right flange (35) of the piston rod (32) overcomes the force of the first spring (13) via the lock plate (53) and the top cap (52) and thereby, pushes the cylinder liner (2) to the left. The lock plate (53) gradually compresses the lock pendulum (73) and simultaneously overcomes the resistance of the fifth spring (76), causing the lock pendulum (73) to rotate around the pivot pin (72). As the cylinder liner (2) moves to the ultimate position of the lock pendulum (73), the lock swing (74) on the lock pendulum (73) protrudes under the force of the forth spring (75), locking the flange (22) of the cylinder liner (2). As the lock plate (53) moves to the left, the cam (50) that is connected to the lock plate (53) slides along the slope (71) of the cylinder liner lock seat (7); this causes the cam (50) to spin. The tip of the cam (50) compresses the top cap (52) and pushes the cylinder liner (2) continuously to the left to its ultimate position; at the same time, the piston rod (32) and the locking ring (33) overcome the resistance of the third spring (34) and move back to their starting positions. Meanwhile, under the effect of the second spring (43), the shifting fork ring (63) moves to the right along the outer diameter of the shifting fork body (60). The inner diameter of the shifting fork ring (63) exerts force on the outer lock bolt (61) and overcomes the resistance of the circlip spring (66). This allows the lock bolt (61) to close and lock the locking ring (33). The waste-discharging outlet (12) on the cylinder sleeve (1) closes and completes the reset process.

What is claimed is:

1. A sewage suction device comprising:

a cylinder sleeve having an interior and a wall, the cylinder sleeve having a stepped hole in the interior and a waste-discharging outlet on the wall;

a cylinder liner with a bottom and a cyliner wall, the cylinder liner having a shaft hole at the bottom wherein the cylinder wall is provided with a flange;

a piston having a piston rod;

a cylinder sleeve cover having an axis and a body, the cylinder sleeve cover having a stepped hole along the axis, the body of the cylinder sleeve cover being provided with a hanging hole;

a first spring that resides between the cylinder liner and the cylinder sleeve;

a cylinder liner lock clutching the piston rod;

a shifting fork assembly being fixed inside the stepped hole of the cylinder sleeve cover;

a ring shaped cylinder liner lock seat having a slope and a pivot pin; and an annular end cover having a center and a through hole through the center;

wherein: the cylinder liner with the bottom is located inside the cylinder sleeve, the piston is located inside the cylinder liner, the cylinder sleeve cover is connected to the cylinder sleeve along the axis, the cylinder liner lock seat is located between the cylinder sleeve and cylinder sleeve cover, the annular end cover caps the cylinder sleeve cover.

2. The sewage suction device according to claim 1, wherein:

the shifting fork assembly comprises a shifting fork body, a lock bolt, a shifting fork rod and a shifting fork ring, the shfiting fork rod having two ends and the shifting fork body having an outer diameter, wherein the shifting fork body is a cylindrical shape, with openings located radial symmetrically on the shifting fork body, the lock bolt is positioned inside that opening and connected to the shifting fork body by pivot pins, the shifting fork ring encircles the shifting fork body's outer diameter, one end of the shifting fork rod connects the shifting fork ring and the other end extends out of the cylinder sleeve cover, and a second spring is located between the shafting fork ring and the cylinder sleeve cover.

3. The swage suction device according to claim 1, further comprising a left flange, a right flange, and a locking ring attached to the piston rod; and a third spring residing between the locking ring and the shifting fork body.

4. The swage suction device according to claim 1, wherein the cylinder liner lock comprises a lining, a top cap and a lock plate; wherein a cam is positioned on the lock plate by a pivot pin; the top cap and the lock plate are located outside the lining; the lining is located outside the piston rod.

5. The swage suction device according to claim 1, wherein:

the cylinder liner lock seat is connected to a lock pendulum by a pivot pin, the lock pendulum has a lock swing, a forth spring is located between the lock swing and the lock pendulum, and a fifth spring is located between the lock pendulum and the cylinder liner lock seat.

6. The swage suction device according to claim 2, further comprising a circlip spring that is located on the lock bolt.

7. The swage suction device according to claim 2, further comprising a first spring that resides between the cylinder liner and the cylinder sleeve; and a left flange, a right flange, and a locking ring attached to the piston rod;

and a third spring residing between the locking ring and the shifting fork body.

8. The swage suction device according to claim 7, wherein the cylinder liner lock comprises a lining, a top cap and a lock plate; wherein a cam is positioned on the lock plate by a pivot pin; the top cap and the lock plate are located outside the lining; the lining is located outside the piston rod.

9. The swage suction device according to claim 8, wherein:

the cylinder liner lock seat is connected to a lock pendulum by a pivot pin, the lock pendulum has a lock swing, a forth spring is located between the lock swing and the lock pendulum, and a fifth spring is located between the lock pendulum and the cylinder liner lock seat.

10. The swage suction device according to claim 9, further comprising a circlip spring that is located on the lock bolt.

11. A sewage suction device comprising:

a cylinder sleeve having an interior and a wall, the cylinder sleeve having a stepped hole in the interior and a waste-discharging outlet on the wall;

a cylinder liner having a bottom and a cyliner wall, the cylinder liner having a shaft hole at the bottom wherein the cylinder wall is provided with a flange;

a first spring that resides between the cylinder liner and the cylinder sleeve;

a piston having a piston rod;

a cylinder sleeve cover having an axis and a body, the cylinder sleeve cover having a stepped hole along the axis, the body of the cylinder sleeve cover being provided with a hanging hole;

a cylinder liner lock clutching the piston rod;

wherein the cylinder liner lock comprises a lining, a top cap and a lock plate; wherein a cam is positioned on the lock plate by a pivot pin; the top cap and the lock plate are located outside the lining; the lining is located outside the piston rod;

a shifting fork assembly being fixed inside the stepped hole of the cylinder sleeve cover, the shifting fork assembly comprises a shifting fork body, a lock bolt, a shifting fork rod and a shifting fork ring, the shfiting fork rod having two ends and the shifting fork body having an outer diameter, wherein the shifting fork body is a cylindrical shape, with openings located radial symmetrically on the shifting fork body, the lock bolt is positioned inside that opening and connected to the shifting fork body by pivot pins, there is a circlip spring located on the lock bolt the shifting fork ring encircles the shifting fork body's outer diameter, one end of the shifting fork rod connects the shifting fork ring and the other end extends out of the cylinder sleeve cover, and a second spring is located between the shafting fork ring and the cylinder sleeve cover, left flange, a right flange, and a locking ring attached to the piston rod; and a third spring residing between the locking ring and the shifting fork body;

a ring shaped cylinder liner lock seat having a slope and a pivot pin;

wherein the cylinder liner lock seat is connected to a lock pendulum by a pivot pin, the lock pendulum has a lock swing, a forth spring is located between the lock swing and the lock pendulum, and a fifth spring is located between the lock pendulum and the cylinder liner lock seat, and an annular end cover having a center and a through hole through the center;

wherein: the cylinder liner with the bottom is located inside the cylinder sleeve, the piston is located inside the cylinder liner, the cylinder sleeve cover is connected to the cylinder sleeve along the axis, the cylinder liner lock seat is located between the cylinder sleeve and cylinder sleeve cover, the annular end cover caps the cylinder sleeve cover.

* * * * *